United States Patent [19]

Kohler et al.

[11] 3,998,921

[45] Dec. 21, 1976

[54] PROCESS FOR PRODUCTION OF POLYESTER THREADS

[75] Inventors: Armin Kohler, Dormagen; Bela von Falkai, Gohr; Klaus Offermann, Dormagen, all of Germany

[73] Assignee: Bayer Aktiengesellschaft, Leverkusen, Germany

[22] Filed: Dec. 11, 1973

[21] Appl. No.: 423,704

Related U.S. Application Data

[63] Continuation of Ser. No. 269,993, July 10, 1972, abandoned.

[30] Foreign Application Priority Data

July 10, 1971 Germany ..... 2134500

[52] U.S. Cl. ..... 264/210 F; 264/290 T; 264/342 RE

[51] Int. Cl.[2] ..... D01D 5/12

[58] Field of Search ..... 264/342 RE, 290 T, 210 F

[56] References Cited

UNITED STATES PATENTS

| | | | |
|---|---|---|---|
| 2,615,784 | 8/1969 | McClellan | 264/290 T |
| 3,159,964 | 12/1964 | Kretsch | 264/342 RE |
| 3,413,797 | 12/1968 | Chapman | 264/342 RE |
| 3,562,382 | 2/1971 | Fowler | 264/290 T |
| 3,564,835 | 2/1971 | Keefe et al. | 264/290 T |
| 3,583,878 | 6/1971 | Ragep et al. | 264/290 T |
| 3,739,056 | 6/1973 | Evans et al. | 264/290 T |
| 3,838,561 | 10/1974 | Munting | 57/140 R |

*Primary Examiner*—Jay H. Woo
*Attorney, Agent, or Firm*—Plumley and Tyner

[57] ABSTRACT

The invention is related to a process for the production of improved, low shrinkage, highly oriented polyester threads which comprises melt spinning a polyester thread, stretching said thread in hot water and shrinking said thread from 3 to 22 % in hot air at temperatures of from 5° to 40° C below the melting point of the polyester over a period of from 3 to 30 seconds. The improved service properties of monofilaments produced in this way are reflected in an increase in the ultimate tensile strength coupled with an increase in elongation, in a shrinkage of less than 1% on boiling, in a heat-included shrinkage of at most 10% at a temperature of 195° C (exposed for 30 minutes in air) and in a very high 2nd moment.

4 Claims, No Drawings

PROCESS FOR PRODUCTION OF POLYESTER THREADS

This is a Continuation, of application, Ser. No. 269,993 filed July 10, 1972 and now abandoned.

This invention relates to polyester threads which have improved service properties and to a process for their production in which monofilaments obtained by melt-spinning are stretched in hot water and are subsequently fixed at elevated temperatures in hot air.

It is known that polyester can be spun into filaments or threads by means of spinning units incorporating fine spinnerets. For example, the threads may be spun into a water bath at temperatures of from 60° to 100 ° C and, thereafter, show minimal variation in diameter, and have a circular cross section and a smooth surface. It is also known that the mechanical and textile properties of these filaments and threads can be considerably improved by stretching. In order that the best possible properties may be obtained, the filaments and threads are stretched in a certain ratio (from about 1 : 3 1 : 6) and within a more or less narrowly defined temperature range from about 80° to 220 ° C). Filaments are generally stretched for example on heated plates or hot godets, although threads are preferably stretched in hot water because of the more favourable heat transfer which is obtained in that process. Depending upon the stretching ratio used, monofilaments produced in this way have average strengths of from 20 to 40 Rkm at 15 to 30 %

$$(Rkm = \text{Reiß}\text{kilometer} = \frac{\text{tensile strength (g)}}{\text{Titer (dtex)}})$$

elongation. Unfortunately, threads produced in this way are restricted in terms of application because they are still subject to a high shrinkage on exposure to boiling water of approximately 10 % (measured after 10 minutes in boiling water) and a high heat induced shrinkage of around 20 % (measured after 10 minutes at 195° C). This is always a disadvantage where the threads are subsequently exposed to thermal stressing during use. For example, sieves made of such unfixed threads distort on contact with hot liquids. Textile products made up from these monofilaments are also dimensionally unstable during dyeing.

It is an object of this invention to provide a process for the production of polyester threads by which the abovementioned disadvantages are avoided.

This object is accomplished by a process for the production of improved, low shrinkage, highly oriented polyester threads which comprises melt spinning a polyester thread, stretching said thread in hot water and shrinking said thread from 3 to 22 % in hot air at temperatures of from 5° to 40° C below the melting point of the polyester over a period of from 3 to 30 seconds.

The stretching of the threads is carried out at a ratio of from 1:4 to 1:6, preferably from 1:4.5 to 1:5.2, at temperatures of from 70° to 100° C, preferably from 90° to 95° C.

Particularly advantageous results are obtained if the process according to this invention is accomplished by using preferable modification, i.e. shrinking said polyester thread from 5 to 12 %, preferably in hot air at a temperature of from 8° to 30° C below the melting point of the polyester, over a period of preferably from 5 to 20 seconds.

This process produces threads showing a 2nd moment which is increased by at least 0.60 to 1.20 Gauss$^2$ compared with untreated polyester threads.

The improved service properties of monofilaments produced in this way are reflected in an increase in the ultimate tensile strength coupled with an increase in elongation, in a shrinkage of less than 1 % on boiling, in a heat-induced shrinkage of at most 10 % at a temperature of 195° C (exposed for 30 minutes in air) and in a very high 2nd moment.

Accordingly, it is another object of this invention to provide high molecular weight polyester threads having a 2nd moment of at least 8.20 Gauss$^2$ at 20° C and of at least 7.50 Gauss$^2$ at 60° C from wide-line nuclear magnetic resonance measurement, and having an orientation of the crystallites of from 0.10 to 0.16 determined from wide-angle X-ray measurement of the azimuthal breadth at half-maximum intensity of the (010)-reflection.

The 2nd moment may be derived from wide-line nuclear resonance measurements carried out using an apparatus of the kind manufactured by the Varian Company of Palo Alto, California, USA. In conventional nuclear-resonance meaurements carried out on molecules in solution, the hydrogen atoms in different molecules do not have any effect upon one measurements and a sharp signal is obtained (cf. A. Losche, "Nuclear Induction," VEB Deutscher Verlag der Wissenschaften Berlin (1957), pp. 273432). However, if nuclear resonance measurements are carried out on solids, in the present case on polyesters, not only are the hydrogen atoms of a single molecule chain activated, but the hydrogen atoms of several chains which lie closely adjacent are also activated and these influence one another. In view of this overlap, it is not possible to obtain a sharp line, instead the line obtained is more or less broadened depending upon the internal structure of the particular sample investigated. The 2nd moment is a measure of the measured breadth of the line and hence indicates simultaneously the interval between the individual molecule chains and their lability. A high 2nd moment, i.e., a very wide line, indicates that the molecule chains are tightly packed and are substantially non-labile because, in this case, not only are hydrogen atoms of one molecule chain activated but the hydrogen atoms of the immediately adjacent molecule chains are also activated.

The resonance line is narrower, i.e., sharper, the wider apart from one another are the molecules and the more labile they are, because in this case only a few adjacent molecules are activated. This arises because the influence of the adjacent nuclei diminishes as $1/r^6$ ($r$ = diameter of a hydrogen nucleus).

The measurements are carried out at 60 Mc/s. The modulation amplitude is 200 milligauss, in order to obtain greater accuracy, each sample is investigated over four measuring lines and the results averaged out. This gives an average error in the 2nd moment of $\pm$ 0.1 Gauss$^2$. Nuclear resonance lines are recorded at 20° and 60° C.

The polyester threads produced by the process according to the invention always show the highest 2nd moment when compared with polyester monofilaments after-treated by a different known method. According to measurements made as described above, it is higher by from 0.30 to 0.80 Gauss$^2$ than in the other polyester threads. Where the measurements are carried out at 20° C, it is generally at least 8.20 Gauss² and, where the measurements are carried out at 60° C, is generally at least 7.50 Gauss². These threads show extremely high crystallinity, i.e., highly oriented and tightly packed molecule chains. This increased orientation reduces the amorphous zones with a corresponding increase in the crystalline zones. In view of this relatively high orientation, the molecules have less space in which to move and are thus able to influence one another. Accordingly, they widen the resonance line, in other words they increase the 2nd moment.

The improvement in the properties obtained by the process according to the invention can also be demonstrated by the intensity ratios in an X-ray diagram (counter-tube goniometer measurement using copper-K-radiation). Monofilaments produced by other known methods generally show an orientation (measured from the azimuthal half-maximum breadth of the (010)-reflection) of from 0.04 to 0.09. It has now been found that the products obtained by the process according to the invention show values of from 0.10 to 0.16 in respect of orientation. This confirms the results obtained by nuclear resonance measurements which indicated that the orientation of the molecule chains in the monofils is greatly increased by the process according to the invention.

Crystallite orientation is determined from wide-angle X-ray measurements. For this purpose, the azimuthal intensity distribution of the (010)-reflection (2 0 = 17.5°) is measured on a conventional counter-tube goniometer. After the background scattering of the bell-shaped curve has been separated off by a straight line, the breadth of the distribution curve is determined at half maximum intensity and converted into angular degrees (c.f. L. Alexander "X-Ray Diffraction Methods in Polymer Science," J. Wiley & Sons, Inc., New York, 1969, pages 198 to 279).

Polyesters suitable for use in the production of the monofilaments with improved properties according to the invention include all those of the kind normally used for the production of filaments or threads. Polyesters of the kind obtained by reacting predominantly aromatic dicarboxylic acids with aliphatic dialcohols are preferred. Examples of suitable dicarboxylic acids include terephthalic acid, isophthalic acid, hexahydroterephthalic acid and, optionally, small quantities of aliphatic dicarboxylic acids such as sebacic acid and adipic acid. Examples of suitable dialcohols include ethylene glycol and 1,4-bis-(hydroxymethyl)-cyclohexane. Mixed polyesters containing the aforementioned components are also suitable. Suitable polyesters are described for example in US Pat. No. 2,465,319 and German Pat. 1,222,205.

The threads obtained by the process according to the invention can be processed into textile products such as woven fabrics, filters, cords and polyester articles, and these show improved dimensional stability in aqueous liquids at temperatures of up to 100 ° C and, even at higher temperatures, undergo only slight distortion.

In the context of the invention, threads are regarded as monofilaments with a diameter of at least 0.1 mm to 5 mm, preferably 0.2 to 2 mm.

The 2nd moment quoted in the Examples and the orientation were determined by the methods described above.

The invention will be further illustrated by the following examples. The invention is not intended to be limited by the details set forth in the examples.

EXAMPLE 1 a. A polyethylene terephthalate with a melting point of 256° C and a $\eta_{rel}$-value of 1.67, as measured in a 1% solution in o-chlorophenol at 25° C, is spun by means of a melt extruder through a single-hole or multiple-hole spinneret into a water bath at 80° C. The thread is then stretched to 4.5 times its original length in a hot water bath at 95° C. The wire produced in this way shows the following properties:

| | |
|---|---|
| diameter | 0.75 mm |
| linear strength | 27 Rkm |
| linear elongation | 26% |
| shrinkage on boiling | 9% |
| heat-induced shrinkage | 20% |
| 2nd moment at 20° C | 7.50 Gauss² |
| 2nd moment at 60° C | 6.60 Gauss² |
| orientation | 0.04 |

b. This thread is delivered to a heating unit in which it is allowed to shrink by 10% at a temperature of 240° C, i.e., 16° C below its melting point, with a contact time of 9 seconds. The thread thus after-treated by the process according to the invention, having a diameter of 0.78 mm, shows the following improved properties :

| | |
|---|---|
| linear strength | 33 Rkm |
| linear elongation | 30% |
| shrinkage on boiling | less than 1% |
| heat-induced shrinkage | 9% |
| 2nd moment at 20° C | 8.30 Gauss² |
| 2nd moment at 60° C | 7.70 Gauss² |
| orientation | 0.15 |

The strength and the elongation have increased whereas the shrinkage on boiling and the heat-induced shrinkage have greatly decreased. At the same time, the molecular orientation, i.e. the crystalline structure of the thread has greatly improved as can be seen from the enormous increase both in the 2nd moment and in the orientation.

c. By way of comparison, the thread obtained as described in a) is guided through the heating unit at the same temperature and with the same shrinkage, but for a shorter contact time than that claimed in accordance with the invention. This contact time is only 2 seconds. There is only a very slight improvement in the properties, as can be seen from the following values:

| | |
|---|---|
| diameter | 0.78 mm |
| linear strength | 27 Rkm |
| linear elongation | 27% |
| shrinkage on boiling | 8% |
| heat-induced shrinkage | 19% |
| 2nd moment at 20° C | 7.55 Gauss² |
| 2nd moment at 60° C | 6.64 Gauss² |
| orientation | 0.06 |

Although the orientation and the shrinkage both improve with a contact time in excess of 30 seconds, the strength falls to less than 20 Rkm. As a result, this thread is limited in respect of its potential applications.

EXAMPLE 2 a. A polyester, whose acid component comprises 90 parts of terephthalic acid and 10 parts of hexahydroterephthalic acid and whose glycol component is ethylene glycol, and which has a melting point of 247° C and a $\eta_{rel}$-value of 1.72, as measured in a 1% solution in o-chlorophenol at 25° C, is spun by means of a melt extruder through a single-hole or multiple-hole spinneret into a water bath at 80° C. The thread is then stretched to 4.6 times its original length in a hot water bath at 95° C. The thread produced in this way has the following properties:

| | |
|---|---|
| diameter | 0.50 mm |
| linear strength | 28 Rkm |
| linear elongation | 19% |
| shrinkage on boiling | 10% |
| heat-induced shrinkage | 18% |
| 2nd moment at 20° C | 7.50 Gauss² |
| 2nd moment at 60° C | 6.70 Gauss² |
| orientation | 0.04 |

b. This wire is delivered to a heating unit in which it is allowed to shrink by 7% at a temperature of 235° C, i.e., 12° C below its melting point, with a contact time of 12 seconds. The thread thus after-treated by the process according to the invention shows the following improved properties, the diameter being 0.51 mm:

| | |
|---|---|
| linear strength | 34 Rkm |
| linear elongation | 35% |
| shrinkage on boiling | less than 1% |
| heat-induced shrinkage | 3% |
| 2nd moment at 20° C | 8.35 Gauss² |
| 2nd moment at 60° C | 7.80 Gauss² |
| orientation | 0.16 |

The strength is greatly improved and the elongation increased whereas the shrinkage on boiling and the heat-induced shrinkage are both reduced to a value approaching zero. The considerable increase in the 2nd moment and in the orientation is indicative of improved orientation of the crystallites within the monofilaments.

c. By way of comparison, the thread obtained in as described in a) is guided through the heating unit for the same contact time and with the same shrinkage, but at a lower temperature and that claimed in accordance with the invention. This temperature is 200° C. There is hardly any improvement in the properties, as can be seen from the following data:

| | |
|---|---|
| diameter | 0.51 mm |
| linear strength | 28 Rkm |
| linear elongation | 24% |
| shrinkage on boiling | 5% |
| heat-induced shrinkage | 17% |
| 2nd moment at 20° C | 7.60 Gauss² |
| 2nd moment at 60° C | 6.75 Gauss² |
| orientation | 0.07 |

The thread cannot be after-treated at a temperature which is higher than 5° C below its melting point because it becomes plastic and tacky, and tears.

EXAMPLE 3 a. A polyester of terephthalic acid and ethylene glycol with a $\eta_{rel}$-value of 1.75, as measured in a 1% solution in o-chlorophenol at 25° C, and with a melting point of 256° C is spun by means of a melt extruder through a single-hole or multiple-hole spinneret into a water bath at 90° C. The wire is then strethced to 4.7 times its original length in a hot water bath at 95° C.

The thread produced in this way as the following properties:

| | |
|---|---|
| diameter | 0.65 mm |
| linear strength | 31 Rkm |
| linear elongation | 17% |
| shrinkage on boiling | 11% |
| heat-induced shrinkage | 20% |
| 2nd moment at 20° C | 7.60 Gauss² |
| 2nd moment at 60° C | 6.75 Gauss² |
| orientation | 0.06 |

b. This thread is delivered to a heating unit in which it is allowed to shrink by 9% at a temperature of 240° C, i.e., 16° C below its melting point, over a contact time of 10 seconds. The thread thus after-treated by the process according to the invention shows the following improved properties, the diameter being 0.67 mm:

| | |
|---|---|
| linear strength | 38 Rkm |
| linear elongation | 33% |
| shrinkage on boiling | less than 1% |
| heat-induced shrinkage | 5% |
| 2nd moment at 20° C | 8.3 Gauss² |
| 2nd moment at 60° C | 7.65 Gauss² |
| orientation | 0.15 |

There is a distinct increase in the strength and an enormous reduction in the shrinkage on boiling and the heat-induced shrinkage. The inner molecular orientation of the wires has also undergone a considerable improvement as can be seen from the increase in the 2nd moment and in the orientation.

c. By way of comparison, a thread obtained as described in a) is guided through the heating unit for the same contact time and at the same temperature but with a lower shrinkage than that according to the invention, namely with only 1% shrinkage. There is hardly any improvement in the original values, as can be seen from the following table:

| | |
|---|---|
| diameter | 0.65 mm |
| linear strength | 30 Rkm |
| linear elongation | 18% |
| shrinkage on boiling | 8% |
| heat-induced shrinkage | 19% |
| 2nd moment at 20° C | 7.80 Gauss² |
| 2nd moment at 60° C | 6.85 Gauss² |
| orientation | 0.07 |

The upmost limit which can be achieved for shrinkage of threads described in this example at the temperature and contact times within the scope of the present claims is 22%.

What we claim is:

1. A process for the production of low shrinkage, highly oriented polyester monofilament having a diameter of 0.1 mm to 5 mm, which consists essentially of (1) melt spinning a fiber forming polyester having a relative viscosity of about 1.75 as measured in a 1% solution in 0-chlorophenol at 15° C; said polyester being derived from ethylene glycol and a dicarboxylic acid, at least 90% by weight of said acid being terephthalic acid; (3) stretching said monofilament in hot water at a temperature of 70°–100° C at a ratio of 1:4 to 1:6; and (3) thereafter shrinking said monofilament from 3% to 22% in hot air at a temperature of from 5° to 40° C below the melting point of said polyester over a period of 3 to 30 seconds.

2. The process of claim 1, wherein the shrinkage is carried out at temperatures of from 8° to 30° C below the melting point of the polyester.

3. The process of claim 1, wherein the shrinkage is carried out over a period of from 5 to 20 seconds.

4. The process of claim 1, wherein the shrinkage is from 5 to 12%.

* * * * *